US009116489B2

(12) United States Patent
Nakagawa et al.

(10) Patent No.: US 9,116,489 B2
(45) Date of Patent: Aug. 25, 2015

(54) IMAGE FORMING APPARATUS FOR STORING SAMPLING VALUES AND METHOD THEREFOR

(71) Applicant: CANON KABUSHIKI KAISHA, Tokyo (JP)

(72) Inventors: Ken Nakagawa, Yokohama (JP); Shinri Watanabe, Mishima (JP); Takeshi Shimba, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 13/859,872

(22) Filed: Apr. 10, 2013

(65) Prior Publication Data

US 2013/0302049 A1 Nov. 14, 2013

(30) Foreign Application Priority Data

May 11, 2012 (JP) ..... 2012-109932

(51) Int. Cl.
*G03G 15/00* (2006.01)
*G03G 15/01* (2006.01)

(52) U.S. Cl.
CPC ..... *G03G 15/5062* (2013.01); *G03G 15/0189* (2013.01); *G03G 15/5058* (2013.01); *G03G 2215/0161* (2013.01)

(58) Field of Classification Search
CPC ..... G03G 15/0189; G03G 15/5058; G03G 15/5062; G03G 2215/0161
USPC ..... 399/15, 45, 49, 72, 74, 301
See application file for complete search history.

(56) References Cited

U.S. PATENT DOCUMENTS

| | | | | |
|---|---|---|---|---|
| 4,970,536 | A * | 11/1990 | Haneda et al. | 347/119 |
| 6,070,022 | A * | 5/2000 | Kobayashi et al. | 399/12 |
| 6,381,435 | B2 | 4/2002 | Shinohara et al. | |
| 7,020,404 | B2 | 3/2006 | Fukuda et al. | |
| 7,315,378 | B2 | 1/2008 | Phelan et al. | |
| 7,668,474 | B2 * | 2/2010 | Muranaka | 399/72 |
| 2007/0036568 | A1 * | 2/2007 | Shida | 399/49 |
| 2007/0053727 | A1 * | 3/2007 | Goto | 399/301 |
| 2011/0194865 | A1 * | 8/2011 | Shida | 399/49 |
| 2012/0099165 | A1 * | 4/2012 | Omori et al. | 358/475 |
| 2013/0156472 | A1 | 6/2013 | Watanabe | |
| 2013/0221205 | A1 * | 8/2013 | Yamasaki et al. | 250/216 |

(Continued)

FOREIGN PATENT DOCUMENTS

| | | | |
|---|---|---|---|
| JP | 1-167769 | A | 7/1989 |
| JP | 11-143171 | A | 5/1999 |

(Continued)

*Primary Examiner* — Francis Gray
(74) *Attorney, Agent, or Firm* — Fitzpatrick, Cella, Harper & Scinto

(57) ABSTRACT

An image forming apparatus includes an image forming unit configured to form a density detection pattern and a reference pattern on an image carrier by a developer; a light-receiving unit configured to receive reflection light of light emitted toward the image carrier, and output a signal corresponding to an amount of received light; a sampling unit configured to sample the signal output from the light-receiving unit, and store sampling values in the storage unit; a detection unit configured to detect the reference pattern; and a determination unit configured to determine a sampling value corresponding to reflection light from the density detection pattern of the color among the sampling values stored in the storage unit, based on a detection time of the reference pattern.

14 Claims, 9 Drawing Sheets

(56) References Cited

U.S. PATENT DOCUMENTS

| | | | | |
|---|---|---|---|---|
| 2013/0272740 | A1* | 10/2013 | Nakagawa et al. | 399/74 |
| 2013/0302048 | A1* | 11/2013 | Sekiguchi et al. | 399/49 |
| 2013/0302050 | A1* | 11/2013 | Shimba et al. | 399/49 |
| 2013/0302051 | A1* | 11/2013 | Shimba et al. | 399/49 |

FOREIGN PATENT DOCUMENTS

| | | | |
|---|---|---|---|
| JP | 2001-166553 | A | 6/2001 |
| JP | 2003-186278 | A | 7/2003 |
| JP | 2004-110018 | A | 4/2004 |
| JP | 2004-188665 | A | 7/2004 |
| JP | 2004-252172 | A | 9/2004 |
| JP | 2004-252321 | A | 9/2004 |
| JP | 2004-361406 | A | 12/2004 |
| JP | 2006-208266 | A | 8/2006 |
| JP | 2006-251652 | A | 9/2006 |
| JP | 2006-267644 | A | 10/2006 |
| JP | 2006-284892 | A | 10/2006 |
| JP | 2007-10744 | A | 1/2007 |
| JP | 2008-185914 | A | 8/2008 |
| JP | 2008-261864 | A | 10/2008 |
| JP | 2009-150690 | A | 7/2009 |
| JP | 2010-117735 | A | 5/2010 |
| JP | 2010271735 | A * | 12/2010 |
| JP | 2012-42884 | A | 3/2012 |

* cited by examiner

IMAGE FORMING APPARATUS FOR STORING SAMPLING VALUES AND METHOD THEREFOR

BACKGROUND OF THE INVENTION

1. Field of the Invention

The present invention relates to registration and density control in an image forming apparatus.

2. Description of the Related Art

Along with the development of a computer network technique, an image forming apparatus such as a printer serving as an image output terminal has rapidly become widespread. In recent years, along with the development of a technique of outputting color images, a demand for improved stability of the quality of an image forming apparatus has increased. Especially for the accuracy of superimposing the color (color registration) and the reproducibility of the density of a printed image, high stability is required despite a change in installation environment, a change with time, or differences between individual apparatuses. Since, however, color registration and an image density in an image forming apparatus vary due to a change caused by continuous use of each driving member or image generation member, a change in temperature within the apparatus, or the like, it is impossible to satisfy such a high requirement with the initial settings. To satisfy such a requirement, the image forming apparatus generally performs calibration to appropriately maintain the color registration and image density. Note that the calibration includes color registration; that is, registration control of correcting the relative position of an image of each color, and density control of correcting an image density.

In calibration, a toner image for test (to be referred to as a detection pattern hereinafter) is formed on a circulating moving member such as a photosensitive member, an intermediate transfer member, or a transfer conveyance belt, thereby measuring the position and density of the detection pattern. Based on the measurement result and the conditions under which the detection pattern has been formed, conditions for changing the color registration and image density such as a latent image writing position, an image forming magnification, a charging voltage, a developing voltage, and an exposure amount are controlled so that the color registration and image density in actual printing become appropriate.

It is impossible to perform any print operation during calibration. If, therefore, calibration is started, a user who wants to perform printing has to wait for completion of the calibration. The time taken for the calibration is, thus, desirably shorter. Japanese Patent Laid-Open No. 2001-166553 proposes a technique of shortening the calibration time by parallelly or sequentially performing registration control and density control. Furthermore, Japanese Patent Laid-Open No. 2003-186278 discloses an arrangement for detecting a detection pattern for registration control and that for density control using three or more sensors.

To perform calibration, a detection pattern may be formed on an image carrier a plurality of times in order to avoid the influence at a position on the image carrier where the detection pattern is formed. At this time, the distance between the detection patterns is set to satisfy predetermined conditions for cancelling the influence at the arrangement positions. That is, there are constraints on the arrangement positions of the detection patterns, and thus the distance between the detection patterns may have to be widened by arranging them to satisfy the constraints. This results in an increase in total length of the detection patterns, thereby prolonging the time taken to form the detection patterns and remove them thereafter.

SUMMARY OF THE INVENTION

The present invention provides an image forming apparatus which relaxes constraints on the arrangement position of a detection pattern, and performs calibration with a short detection pattern.

According to an aspect of the present invention, an image forming apparatus includes: a storage unit; an image forming unit configured to form, for each of a plurality of colors, a density detection pattern for detecting a density and a reference pattern for specifying a position of the density detection pattern on an image carrier by a developer; a light-receiving unit configured to receive reflection light of light emitted toward the image carrier, and output a signal corresponding to an amount of received light; a sampling unit configured to sample the signal output from the light-receiving unit, and store sampling values in the storage unit; a detection unit configured to detect the reference pattern by comparing the signal corresponding to the amount of received light with a threshold; and a determination unit configured to determine, for at least one of the plurality of colors, a sampling value corresponding to reflection light from the density detection pattern of the color among the sampling values stored in the storage unit, based on a detection time of the reference pattern of the color detected by the detection unit.

Further features of the present invention will become apparent from the following description of exemplary embodiments with reference to the attached drawings.

DESCRIPTION OF THE EMBODIMENTS

Exemplary embodiments of the present invention will be described below with reference to the accompanying drawings. Note that components which are not necessary for a description of the embodiments will be omitted from the accompanying drawings.

First Embodiment

Figure 1:
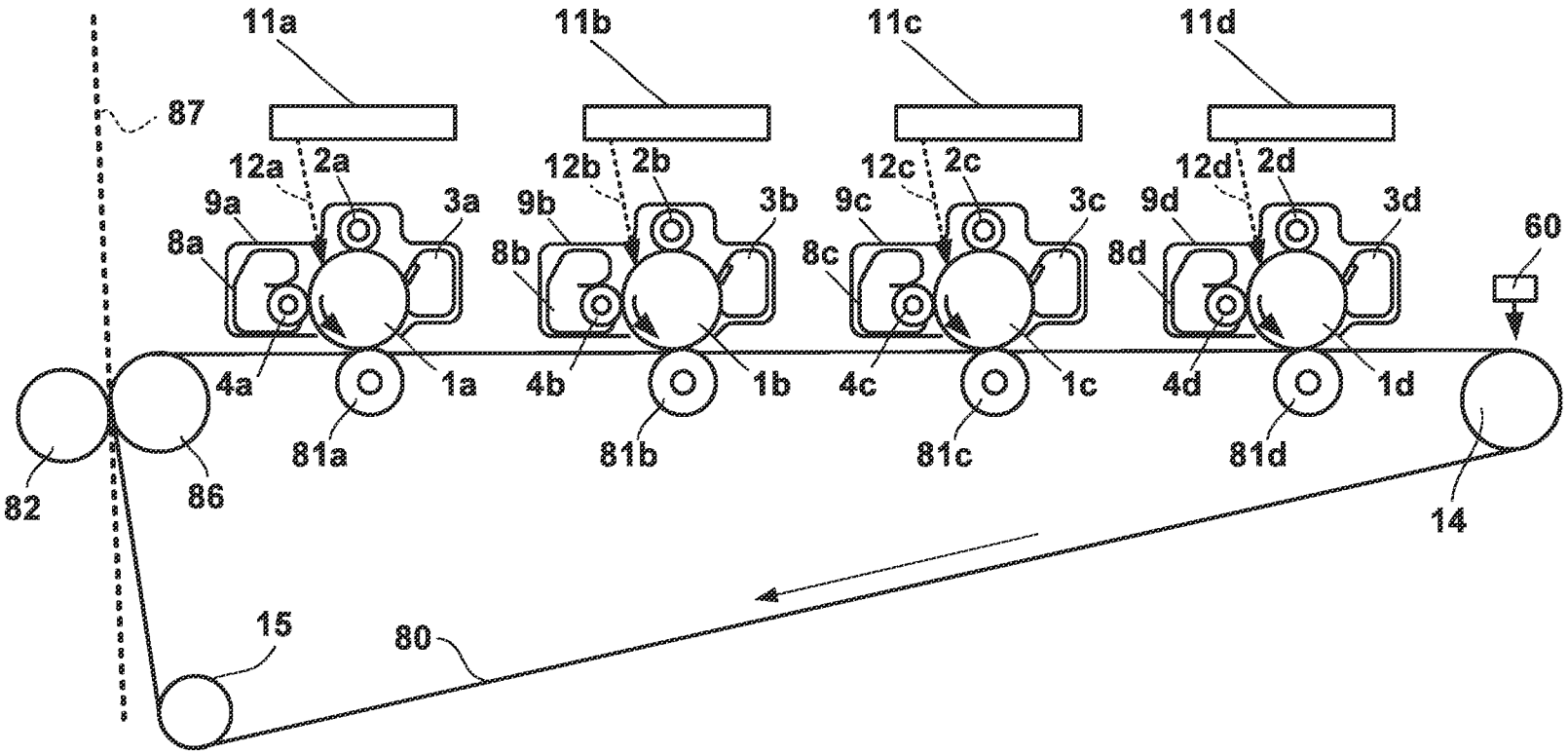
FIG. 1 is a view showing the arrangement of the image forming unit of an image forming apparatus according to an embodiment.

FIG. 1 is a view showing the arrangement of the image forming unit of an image forming apparatus according to the present embodiment. Referring to FIG. 1, components denoted by reference numerals added with letters a, b, c, and d respectively correspond to the components of first, second, third, and fourth stations. Note that in this embodiment, the first, second, third, and fourth stations are used to form toner images as developer images of yellow (Y), magenta (M), cyan (C), and black (K), respectively, on an intermediate transfer belt 80 as an image carrier. The first to fourth stations have the same arrangement except for the colors of toners as developers. Therefore, reference numerals without letters a, b, c, and d are used when colors need not be distinguished from each other.

A charging roller 2 is contact with a photosensitive member 1 rotating in a direction indicated by an arrow, and charges the surface of the photosensitive member 1 to negative polarity. An exposure unit 11 scans the photosensitive member 1 with a scanning beam 12 modulated based on an image signal, thereby forming an electrostatic latent image on the photosensitive member 1. A developing unit 8 has toner as the developer of a corresponding color, and develops the electrostatic latent image on the photosensitive member 1 with the toner using a developing bias applied to a developing roller 4, thereby forming a toner image. A primary transfer roller 81 applies a DC bias having a polarity (positive polarity) opposite to that of the toner, thereby transferring the toner image on the corresponding photosensitive member 1 to the intermediate transfer belt 80. Furthermore, a cleaning unit 3 removes the toner not transferred to the intermediate transfer belt 80 and remaining on the photosensitive member 1. In this embodiment, the photosensitive member 1, developing unit 8, charging roller 2, and cleaning unit 3 form an integrated process cartridge 9 detachable from the image forming apparatus.

The intermediate transfer belt 80 is an endless belt supported by three rollers, that is, a secondary transfer counter roller 86, a tension roller 14, and an auxiliary roller 15 as loop members, and is maintained under an appropriate tension by the tension roller 14. When the secondary transfer counter roller 86 as a driving roller is driven, the intermediate transfer belt 80 moves in a direction indicated by an arrow at almost the same speed in the forward direction with respect to the photosensitive member 1. The first to fourth stations transfer toner images of the respective colors to the intermediate transfer belt 80 by superimposing the images, thereby forming a color image on the intermediate transfer belt 80. The toner images formed on the intermediate transfer belt 80 are transferred to a printing material conveyed through a convey path 87 by a secondary transfer roller 82. After that, the toner images transferred to the printing material are fixed on it by a fixing unit (not shown). In this embodiment, a sensor unit 60 for calibration control is arranged downstream of the fourth station in the moving direction of the intermediate transfer belt 80. Note that although calibration control is performed by forming detection patterns on the intermediate transfer belt 80 in this embodiment, detection patterns may be formed on another image carrier.

Figure 2:
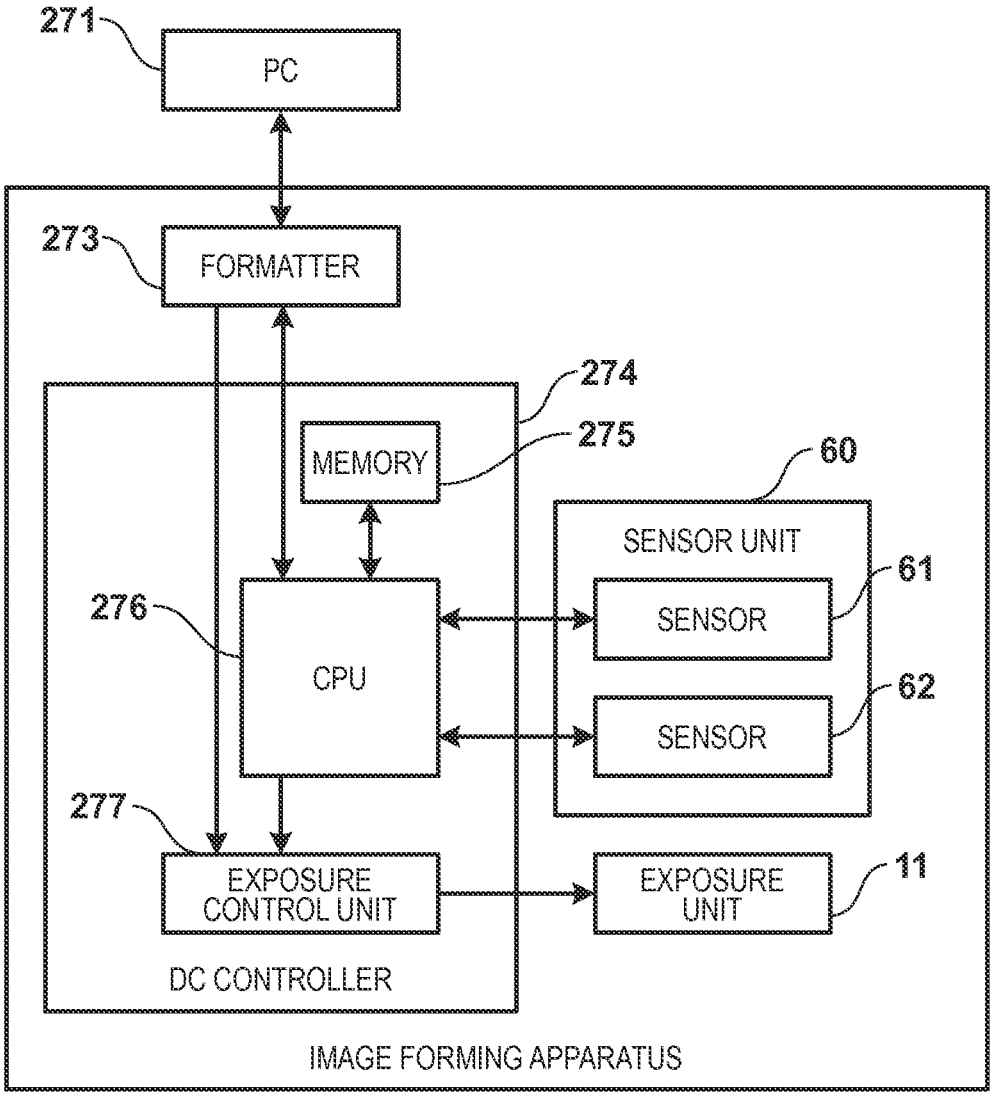
FIG. 2 is a block diagram showing the image forming apparatus according to an embodiment.

FIG. 2 is a block diagram showing the image forming apparatus according to the embodiment. A PC 271 serving as a host computer outputs a print instruction to a formatter 273 within the image forming apparatus, and transfers the image data of a print image to the formatter 273. The formatter 273 converts the image data from the PC 271 into exposure data, and transfers it to an exposure control unit 277 of a DC controller 274. The exposure control unit 277 is controlled by a CPU 276, turns on/off the exposure data, and controls the exposure unit 11. Upon receiving the print instruction from the formatter 273, the CPU 276 starts a control operation for image formation. A memory 275 serves as a work area for the CPU 276.

The CPU 276 receives a signal detected by the sensor unit 60. As shown in FIG. 2, the sensor unit 60 includes sensors 61 and 62. The sensor 61 is used to detect a detection pattern formed near one edge portion of the surface of the intermediate transfer belt 80 in a direction perpendicular to the moving direction. The sensor 62 is used to detect a detection pattern formed near the other edge portion.

Calibration will be described next. Calibration control includes registration control and density control. The registration control is performed to adjust the relative forming position of a toner image in each image forming station, and has to obtain a good print result by eliminating so-called "misregistration". In this embodiment, the registration control is performed by forming a registration detection pattern in each edge portion of the intermediate transfer belt 80, and measuring the misregistration amounts of other colors with respect to a reference color by the sensors 61 and 62.

Density control is performed to adjust the image density, and has as its object to correct the image density which varies depending on the temperature and humidity conditions around the image forming apparatus and the use amount of each image forming station. In density control, a density detection pattern is formed on the intermediate transfer belt 80 to measure a physical quantity correlated with the toner amount of the density detection pattern, and control targets associated with image generation such as exposure data, a charging voltage, and a developing voltage are corrected so as to obtain a desired density. In this embodiment, a density detection pattern is formed in only one edge portion of the intermediate transfer belt 80, and the sensor 61 reads the formed density detection pattern.

Figure 3:
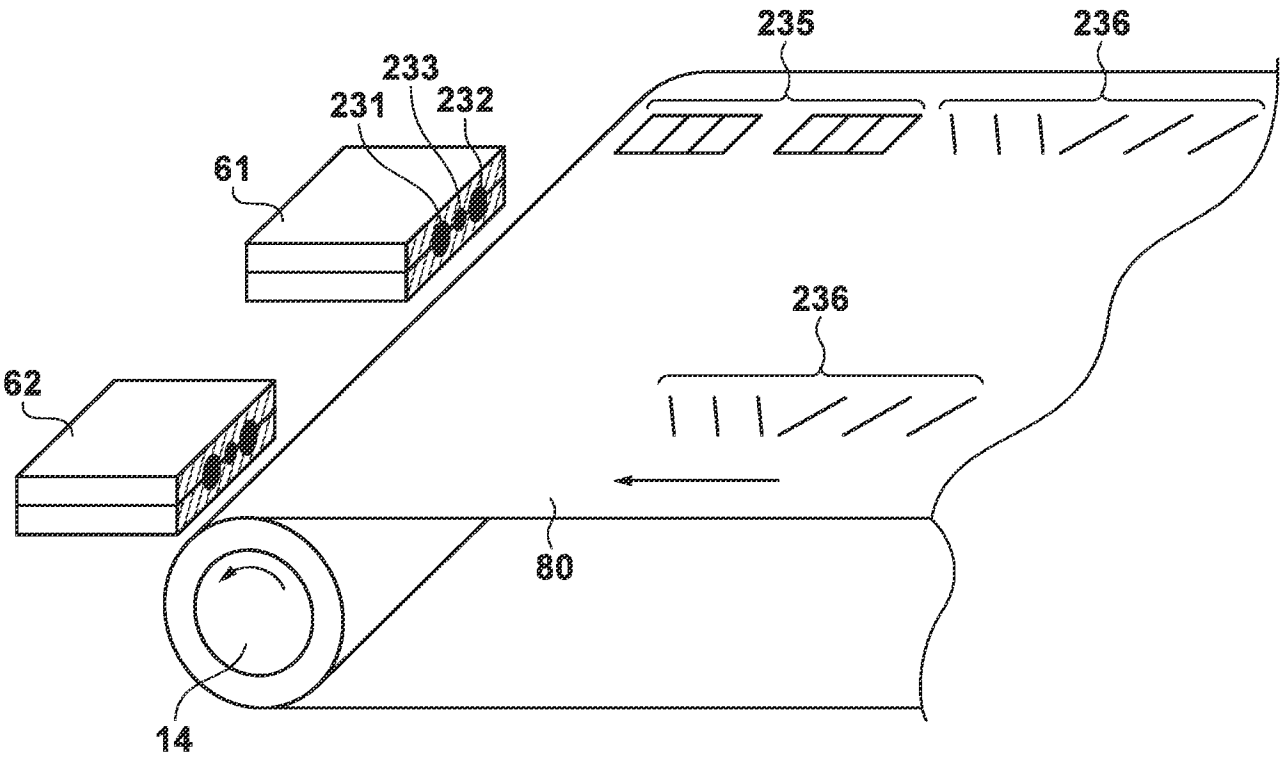
FIG. 3 is a view showing the relationship between a sensor unit and an intermediate transfer belt according to an embodiment.

FIG. 3 is a view showing the exemplary relationship between the intermediate transfer belt 80 and the sensors 61 and 62. In calibration according to the present embodiment, a detection pattern is formed in each edge portion, in a direction perpendicular to the moving direction, of the intermediate transfer belt 80 moving in a direction indicated by an arrow in FIG. 3, and each of the sensors 61 and 62 detects the detection pattern in a corresponding edge portion. More specifically, the sensor 61 or 62 emits light toward the intermediate transfer belt 80, thereby detecting the position of the detection pattern based on reflection light, and detecting the density based on the intensity of the reflection light.

The tension roller 14 which keeps appropriate tension on the intermediate transfer belt 80 is driven in a direction indicated by an arrow in FIG. 3 by movement of the intermediate transfer belt 80. The intermediate transfer belt 80 loops around the tension roller 14. In this embodiment, the sensors 61 and 62 are arranged to face a cylindrical curved plane. The sensor 61 or 62 is positioned with respect to the bearing of the tension roller so that the distance between the tension roller 14 and the sensor 61 or 62 does not change even if the tension roller 14 moves. FIG. 3 shows a case in which a density detection pattern 235 and a registration detection pattern 236 are formed on the intermediate transfer belt 80.

The sensor 61 emits light from an exit hole 233 toward the intermediate transfer belt 80. The spot of light on the intermediate transfer belt 80, that is, a light irradiation spot has an almost circular shape with a diameter of, for example, 3 mm. Light reflected by the intermediate transfer belt 80 or the detection patterns formed on it passes through incident holes 231 and 232 to reach a light-receiving element within the sensor 61. The detection patterns formed on the intermediate transfer belt 80 sequentially enter the reflection position of the light irradiation spot as the detection region of the sensor 61 by the movement of the intermediate transfer belt 80, and a change in amount of received light of the light-receiving element with time is converted into a voltage signal. Note that the sensor 62 is similar to the sensor 61 and a description thereof will be omitted.

Figure 4:
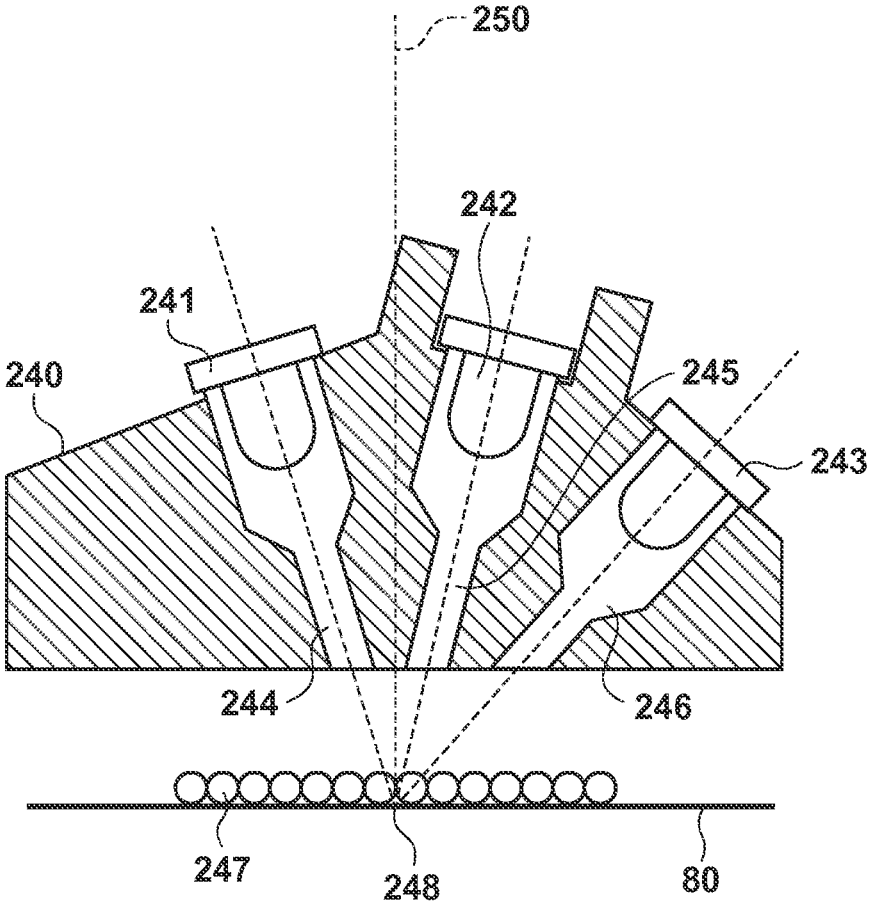
FIG. 4 is a view showing the arrangement of a sensor according to an embodiment.

FIG. 4 is a sectional view showing the sensor 61. In the sensor 61, a light-emitting element 242 such as an LED and light-receiving elements 241 and 243 such as phototransistors are attached to a sensor housing 240. Light emitted by the light-emitting element 242 passes through an exit light guide 245 to a spot 248 on a detection pattern 247 as a measurement target or on the surface of the intermediate transfer belt 80. Diffuse reflection light reflected by the spot 248 passes through an incident light guide 246 to reach the light-receiving element 243, which then converts it into an electrical signal. Specular reflection light reflected by the spot 248 passes through an incident light guide 244 to reach the light-receiving element 241, which then converts it into an electrical signal.

The center line of the exit light guide 245 and that of the incident light guide 244 are provided at the same angle with respect to a normal 250 to the intermediate transfer belt 80 so as to receive specular reflection light. On the other hand, the incident light guide 246 is provided at a position on a side opposite to the reflection side of specular reflection light at an angle such that specular reflection light from the intermediate transfer belt 80 does not enter.

The arrangement of the sensor 62 is the same as that of the sensor 61. In this embodiment, however, the sensor 62 detects only the registration detection pattern 236, and thus can have an arrangement without the light-receiving element 241 or 243, as shown in FIG. 3. This is because in registration control, it is only necessary to identify the presence/absence of a detection pattern, and thus it is necessary to use only one of specular reflection light and diffuse reflection light. Note that if specular reflection light is used to perform registration control, control is tolerant of electrical noise. On the other hand, if diffuse reflection light is used to perform registration control, control is tolerant of a flaw of the intermediate transfer belt 80.

Note that any wavelength falling within the range from the ultraviolet region to the infrared region can be used as the wavelength of light emitted by the light-emitting element 242 as long as light with the wavelength is absorbed by the detection pattern of black and is diffusely reflected by the detection patterns of other colors. For example, an infrared LED with a wavelength of 950 nm can be used as the light-emitting element 242. Note that if the amount of diffuse reflection light from the surface of the intermediate transfer belt 80 as an underlayer is large, it becomes difficult to detect a detection pattern. To suppress diffuse reflection, the color of the surface of the intermediate transfer belt 80 can be black which suppresses diffuse reflection.

Figure 5:
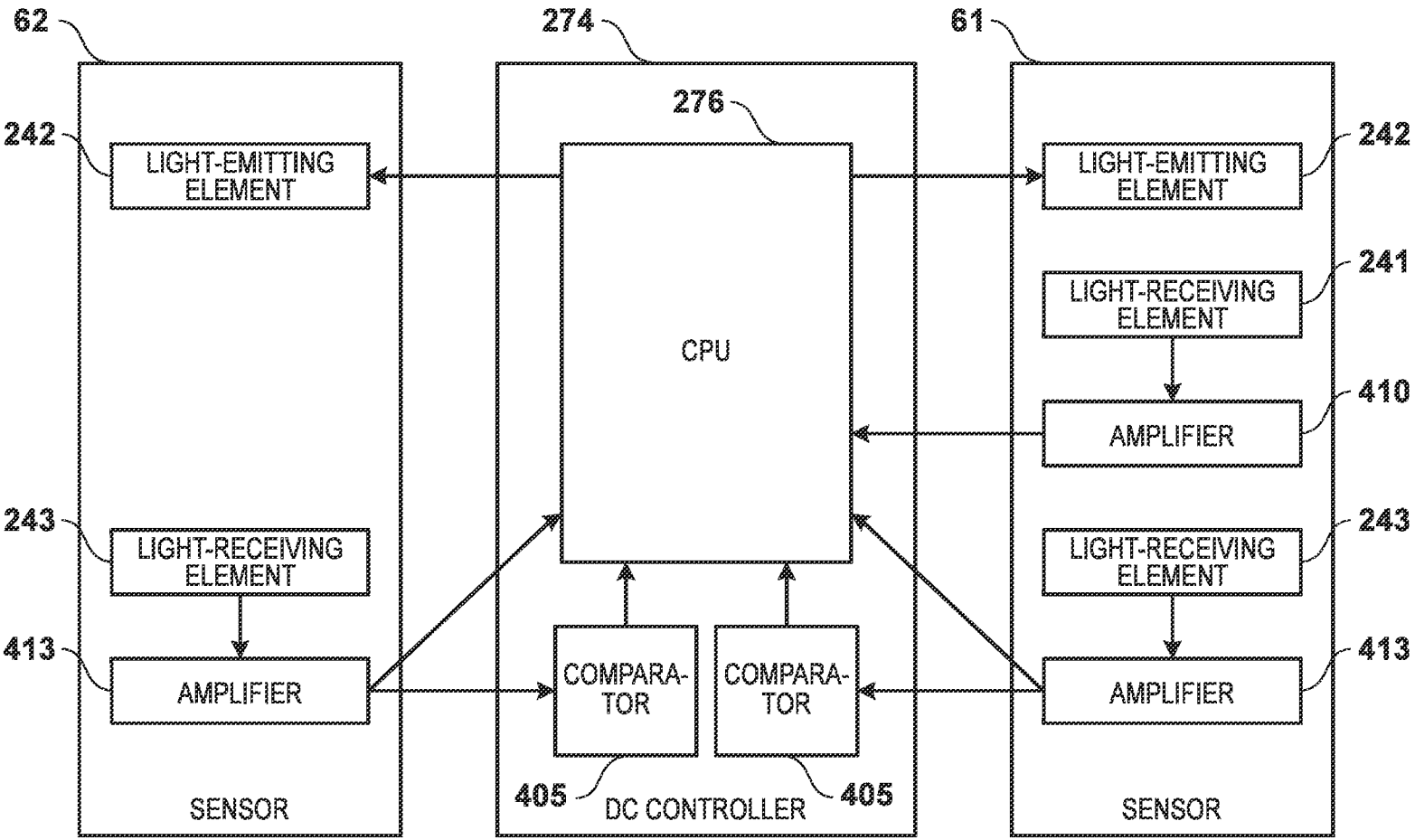
FIG. 5 is a block diagram showing the relationship between the sensor and a DC controller according to an embodiment.

FIG. 5 is a block diagram showing signal processing by the sensors 61 and 62. Note that in FIG. 5, the sensor 62 includes only one light-receiving element 243 which receives diffuse reflection light. The CPU 276 of the DC controller 274 controls the amount of light emitted by the light-emitting element 242 of the sensor 61 or 62. Each light-receiving element 243 for diffuse reflection light of the sensor 61 and 62 outputs an electrical signal corresponding to the amount of received light, and each amplifier 413 amplifies the electrical signal output from the corresponding light-receiving element 243 to have appropriate amplitude. The electrical signal corresponding to the diffuse reflection light detected by the light-receiving element 243 is sent to the CPU 276 via two paths. The first path is a path in which the signal is input from the amplifier 413 directly to the AD conversion port of the CPU 276. The CPU 276 samples the voltage value of the electrical signal input to the AD conversion port at a given interval, and stores sampling values corresponding to the amount of diffuse reflection light in the memory 275. The second path is a path in which the signal is input via a comparator 405. The comparator 405 compares the voltage of the electrical signal output from the amplifier 413 with a reference voltage, and outputs, to the interrupt port of the CPU 276, a signal at "high" or "low" level depending on whether the voltage of the electrical signal is equal to or larger than the reference voltage. The CPU 276 monitors the state of the interrupt port all the time. If an interrupt occurs, that is, the state of an input signal changes, the CPU 276 records the time of the event. The DC controller 274 has an arrangement in which it is possible to parallelly perform time measurement with a high time resolution by the interrupt port and relatively coarse time measurement by the AD conversion port. In this embodiment, the electrical signal output from the light-receiving element 241 for regular reflection light of the sensor 61 is amplified by an amplifier 410, and input to the AD conversion port of the CPU 276. The CPU 276 samples the voltage value of the electrical signal input to the AD conversion port at a given interval, and stores sampling values corresponding to the amount of regular reflection light in the memory 275.

Figure 6A:
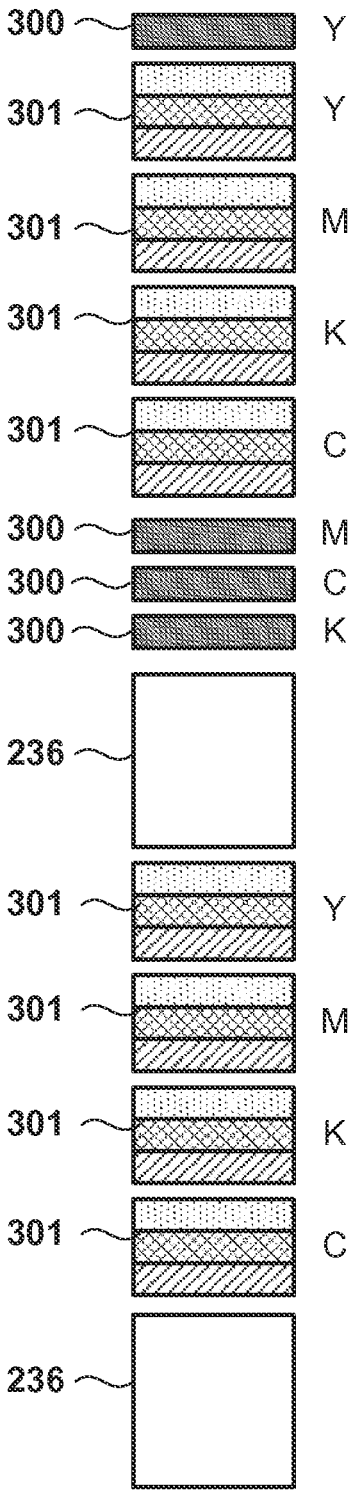
FIGS. 6A and 6B are views showing detection patterns according to an embodiment.
Figure 6B:
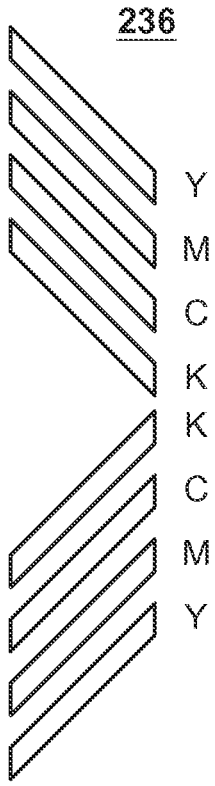

Calibration control according to the present embodiment will now be described. FIGS. 6A and 6B show examples of detection patterns formed on a side of the intermediate transfer belt 80 on which the sensor 61 is arranged according to the present embodiment. Referring to FIG. 6A, letters Y, M, C, and K indicate that the colors of corresponding toner images are yellow, magenta, cyan, and black, respectively. In FIG. 6A, reference numerals 301 denote density detection patterns, and a reference numeral 300 denotes a reference pattern of each color for specifying the position of a density detection pattern 301 of the same color. Note that in this embodiment, as shown in FIG. 6A, the density detection pattern 301 of each color includes three patch images of different densities. This is merely an example, and any number of densities may be used. The reference pattern 300 of each color is a patch image to be used to specify the position of the density detection pattern 301 of the corresponding color, and is formed by a solid image with a sufficiently high density, for example, a density of 100%, such that the sensor 61 can reliably detect the image.

Note that in this embodiment, two density detection patterns 301 are used for each color. The density detection patterns 301 are arranged so that the distance between the density detection patterns 301 of the same color is n/2 times (n is an odd number) the rotation period of the tension roller 14. That is, the density detection patterns 301 of the same color are arranged at positions having a phase opposite to that of the rotation period of the tension roller 14. This arrangement enables to cancel the influence of a variation in rotation period on density detection even if a variation in rotation period of the tension roller 14 occurs on the surface of the intermediate transfer belt 80 due to eccentricity of the tension roller 14.

In this embodiment, two registration detection patterns 236 each specifically shown in FIG. 6B are formed on the intermediate transfer belt 80, as shown in FIG. 6A. Note that the registration detection patterns 236 are arranged so that the distance between the patches of the same color with the same orientation of the registration detection patterns 236 is m/2 times (m is an odd number) the rotation period of a roller for driving the intermediate transfer belt 80, that is, the secondary transfer counter roller 86 in this embodiment. This arrangement is adopted to cancel the influence on registration control even if a variation in rotation period of the roller for driving the intermediate transfer belt 80 occurs due to eccentricity of the roller, thereby causing a variation in moving speed of the intermediate transfer belt 80.

Note that in this embodiment, two registration detection patterns 236 shown in FIG. 6B are formed on the side of the intermediate transfer belt 80 on which the sensor 62 is arranged, and the arrangement constraints on the registration detection patterns 236 are the same as those on the registration detection patterns 236 arranged on the sensor 61 side. Note also that the number of patterns formed on each side of the intermediate transfer belt 80 for each detection pattern is not limited to two.

As described above, if a plurality of detection patterns are formed to cancel the influence of the rotation period of each roller, there are constraints on the forming positions of the detection patterns. In this embodiment, density control and registration control are sequentially performed, and it is thus possible to arrange a plurality of detection patterns within one round of the intermediate transfer belt 80 while satisfying the above constraints. That is, in this embodiment, the reference pattern 300 of each color used for density control is provided for a set of density detection patterns 301 of the same color, and the reference pattern 300 can be arranged at an arbitrary position. More specifically, it is possible to decide the arrangement positions of the density detection patterns 301 and registration detection patterns 236 to satisfy the constraints, and then arrange the respective reference patterns 300 in a free region. This can shorten the total length of the detection patterns.

Figure 7:
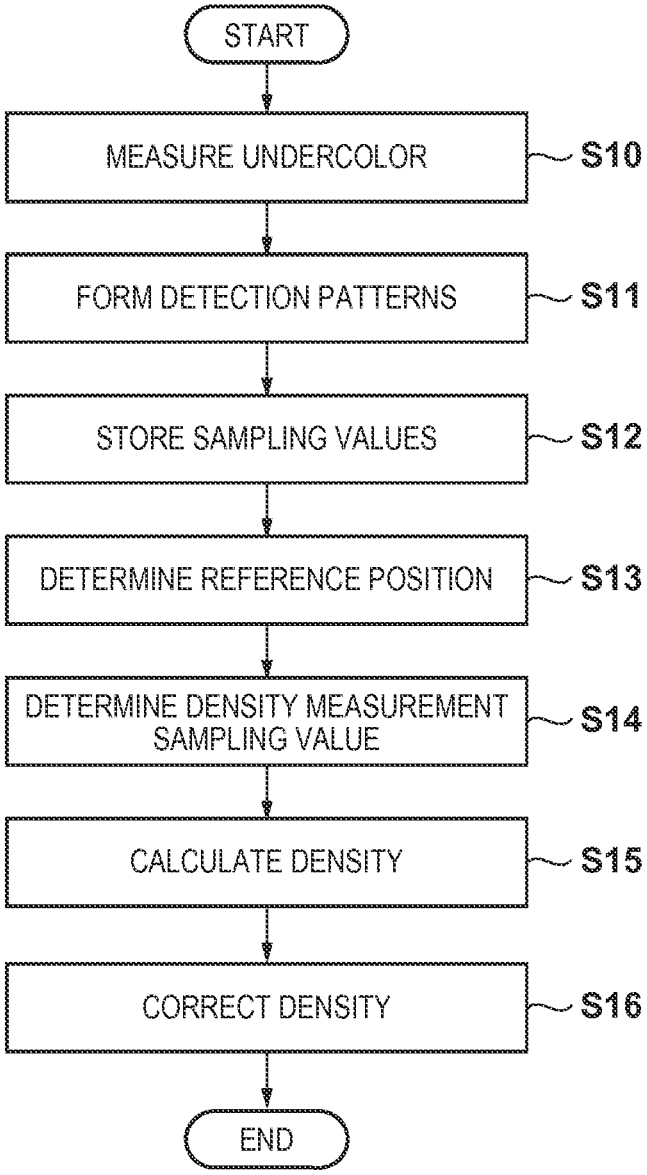
FIG. 7 is a flowchart illustrating calibration control according to an embodiment.

The calibration control according to the present embodiment will be described with reference to FIG. 7. Upon start of the calibration control, the DC controller 274 measures (the undercolor of) light reflected by the surface of the intermediate transfer belt 80. More specifically, signal levels output from the light-receiving elements 241 and 243 of the sensor are recorded at a predetermined sampling interval over about one round of the intermediate transfer belt 80. This processing records the level of the light reflected by the surface of the intermediate transfer belt 80 at a position where a detection pattern is formed.

In step S11, the DC controller 274 forms the above-described detection patterns on the intermediate transfer belt 80. In step S12, the DC controller 274 samples and acquires a signal output from each light-receiving element of the sensors 61 and 62 at the AD conversion port of the CPU 276 at the predetermined sampling interval, and stores sampling values in the memory 275. Note that sampling starts before the detection patterns reach the detection region of the sensors 61 and 62, and continues until all the detection patterns pass through the detection region. Note that if data is input to the interrupt port of the CPU 276, the time of the event is also stored in the memory 275.

In step S13, the DC controller 274 determines the reference position of each color. The reference position corresponds to the detection time of the reference pattern 300 of the corresponding color. Details thereof will be described below with reference to FIG. 8.

Figure 8:
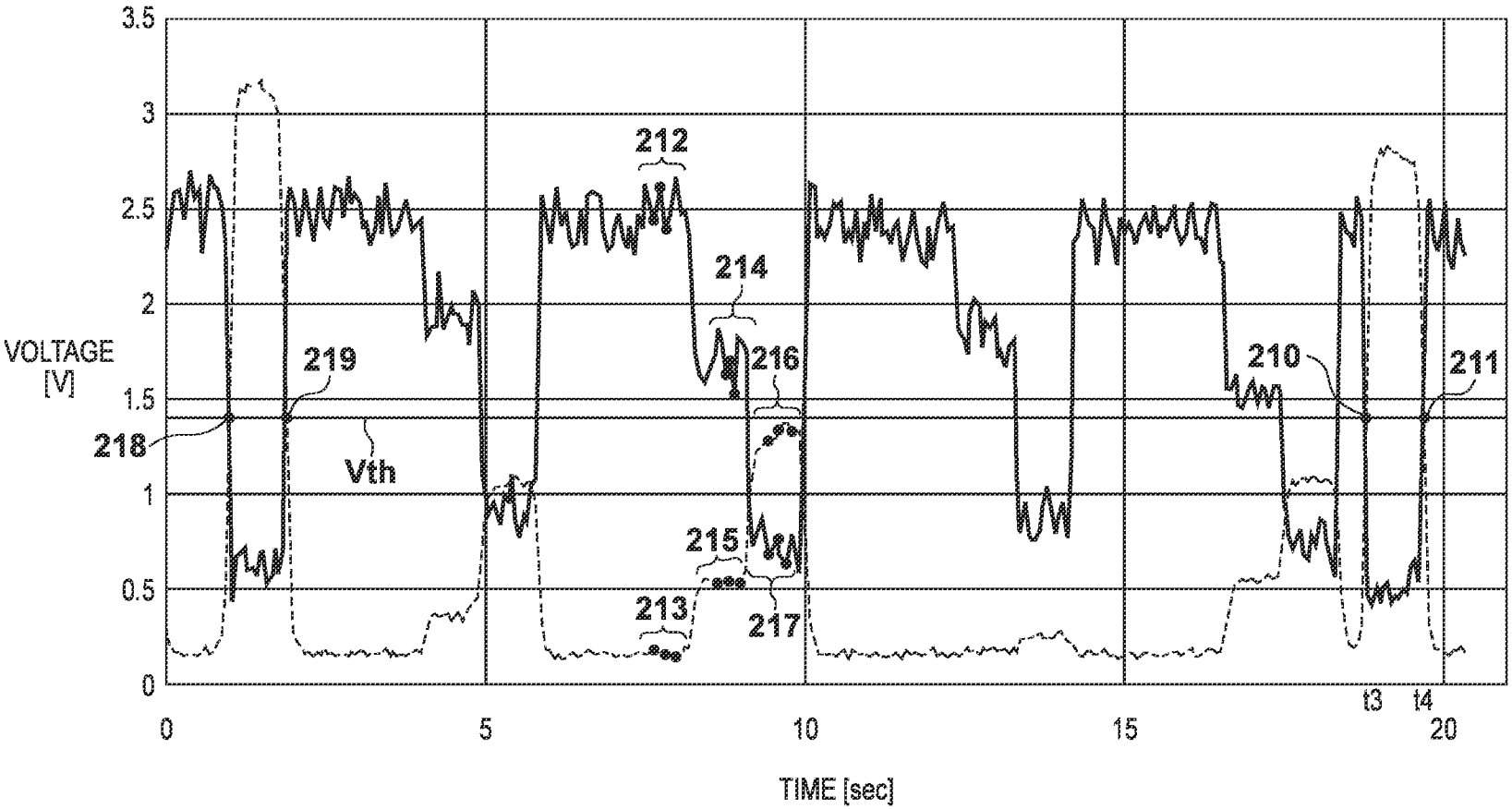
FIG. 8 is a timing chart showing the output signal waveform of the sensor according to an embodiment.

FIG. 8 shows examples of sampling values acquired when the reference pattern 300 of yellow to that of magenta of the detection patterns shown in FIG. 6A pass through the detection region of the sensor 61. Note that in FIG. 8, the ordinate represents the output voltage of the sensor 61 as a sampling value, and the abscissa represents time. A solid line corresponds to the amount of received specular reflection light of the light-receiving element 241, and a dotted line corresponds to the amount of received diffuse reflection light of the light-receiving element 243.

A line denoted by reference symbol Vth in FIG. 8 indicates 1.4 V, which is the reference voltage of the comparator 405. If a diffuse reflection signal level intersects with the threshold Vth, an interrupt signal is input to the CPU 276. Sampling points 218 and 219 correspond to the leading and trailing edge positions of the reference pattern 300 of yellow in the moving direction of the surface of the intermediate transfer belt 80, and an interrupt occurs in the CPU 276 at each of these points. The DC controller 274 calculates the average of times when the interrupts occur at the sampling points 218 and 219, and stores it as the position of the reference pattern 300 of yellow in the memory 275. Similarly, sampling points 210 and 211 correspond to the leading and trailing edge positions of the reference pattern 300 of magenta. The CPU 276 calculates the average of times when interrupts occur at the edge positions, and stores it as the position of the reference pattern 300 of magenta. The position of the reference pattern 300 of cyan is also calculated in a similar manner. Note that for black, a reference position is calculated using a method of comparing a specular reflection sampling value with the threshold. Note also that the reference position may be calculated by comparing the sampling value stored in the memory 275 with the threshold instead of an interrupt from the comparator 405.

Figure 9:
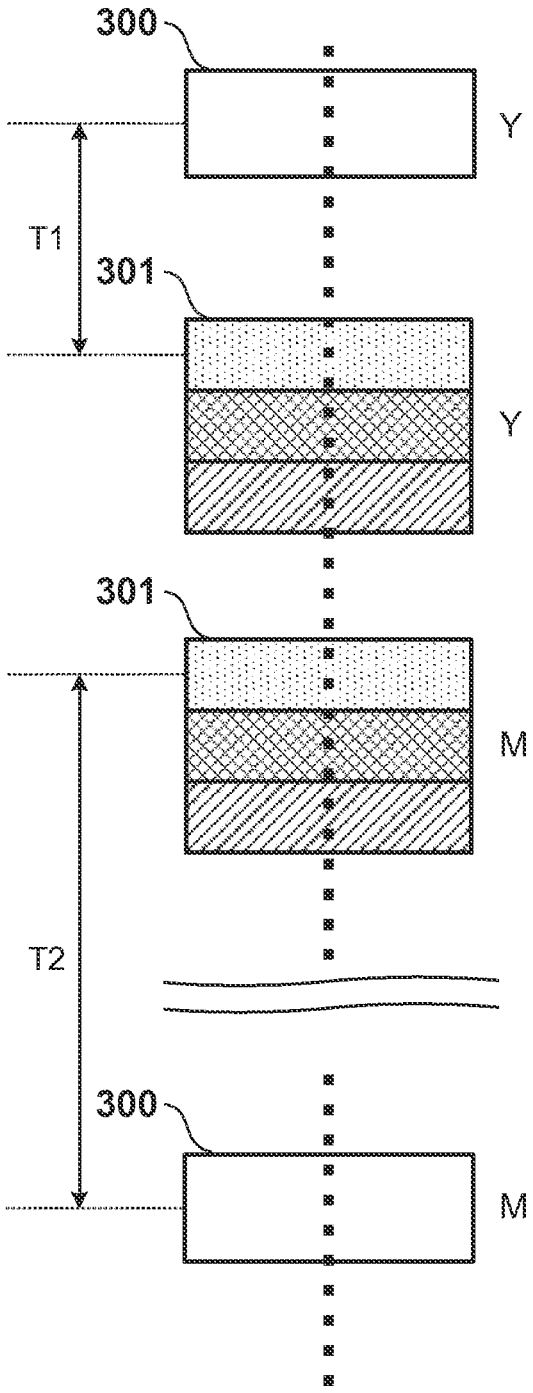
FIG. 9 is a view for specifically explaining the positions of density measurement patches according to an embodiment.

In step S14, the DC controller 274 determines a sampling value corresponding to the density detection pattern 301 of each color among the sampling values stored in the memory 275. FIG. 9 shows, among the detection patterns shown in FIG. 6A, the reference patterns 300 of yellow and magenta and the density detection patterns 301 of yellow and magenta. Note that black dots in FIG. 9 indicate sampling positions. The relative positions of the respective colors with respect to each other are not constant due to so-called misregistration. The distance between the reference pattern 300 and density detection pattern 301 of the same color is almost constant even if the position of the color shifts from the reference color. That is, a time difference T1 corresponding to the distance between the reference pattern 300 and density detection pattern 301 of yellow and a time difference T2 corresponding to the distance between the reference pattern 300 and density detection pattern 301 of magenta are extremely stable in FIG. 9. It is, therefore, possible to specify a sampling value corresponding to light reflected by the density detection pattern 301 of each color based on the reference position of the corresponding color in step S13. For example, as shown in FIG. 9, a sampling value the time T1 after the reference position of yellow obtained in step S13 is near the center of the first toner image with a density among the three toner images with different densities of the density detection pattern 301 of yellow. Similarly, a sampling value the time T2 before the reference position of magenta obtained in step S13 is near the center of the first toner image with a density among the three toner images with different densities of the density detection pattern 301 of magenta. Note that the same applies to sampling values near the centers of the two remaining toner images with different densities. As described above, the DC controller 274 determines a sampling value from each density detection pattern 301 among the sampling values of specular reflection and diffuse reflection.

With reference to FIG. 8, a sampling point closest to a time the time T2 before the reference position of magenta as the average of the sampling points 210 and 211 indicates a sampling value near the center of the first toner image of the density detection pattern 301 of magenta. Referring to FIG. 8, sampling points 212 and 213 are such sampling points. Similarly, sampling values near the centers of the second and third toner images with different densities among the three toner images with different densities of the density detection pattern 301 of magenta are specified. Referring to FIG. 8, sampling points 214 and 215 and sampling points 216 and 217, respectively, are such sampling points. Since the density varies near the edge of the patch image of each density, the average of values at a predetermined number of sampling points near the central portion of the patch of each density is stored as a measurement value, as described above.

Referring back to FIG. 7, in step S15, the DC controller 274 obtains a density based on the measurement value obtained in step S14. More specifically, the DC controller 274 calculates a physical quantity correlated with the amount of toner of a detection pattern. For example, it is possible to use a method of obtaining the ratio of the net amount of light reflected by the intermediate transfer belt 80, and converting it into a toner density using a lookup table.

Let, for example, Vsb and Vrb be the sampling values of specular reflection light and diffuse reflection light from the surface of the intermediate transfer belt 80, and Vst and Vrt be the sampling values of specular reflection light and diffuse reflection light from the toner image of a given density of the density detection pattern 301. Furthermore, let Vsk and Vrk be the sampling values of specular reflection light and diffuse reflection light from the reference pattern 300. Note that all the values are obtained by subtracting a dark voltage. In this case, the net specular reflectance can be obtained according to:

$$(Vst-Vsk/Vrk\cdot Vrt)/(Vsb-Vsk/Vrk\cdot Vrb)$$

Correlations between the specular reflectance and physical quantities such as a print density, a print chromaticity, and the amount of toner are prepared as a lookup table in advance. Conversion into a desired physical quantity is possible by referring to the table.

In step S16, the DC controller 274 performs density correction. More specifically, the DC controller 274 creates a correction table as correction data of the respective densities based on the density obtained in step S15. In subsequent printing, an image signal is sent to the exposure unit 11 by correcting image data with the correction table. This controls to obtain a small difference between a target density and a print density.

Note that registration control can be performed by an interrupt in the CPU 276 caused by the registration detection pattern 236. Note also that the DC controller 274 can determine an interrupt caused by the registration detection pattern 236 by counting the number of times an interrupt occurs. Processing of determining the position of each color using the registration detection pattern 236 and calculating a relative misregistration amount can be performed parallel to the processing in steps S14 to S16 after step S13.

As described above, the sampling values of the density detection pattern 301 are stored. Sampling values corresponding to light reflected by the density detection pattern 301 are specified after specifying the position of the reference pattern 300, and sampling points to be used for density control are selected. This arrangement enables to arrange the reference pattern 300 after the density detection pattern 301 of the same color. That is, it is possible to arrange the reference pattern 300 at an arbitrary position, thereby allowing to densely arrange the detection patterns while satisfying the arrangement constraints of the period of the roller. That is, it is possible to shorten the length of the detection patterns.

Note that in the above-described embodiment, the densities of the density detection patterns 301 of all the colors are obtained based on the stored sampling values. For a color, the reference pattern 300 of which is detected before the density detection pattern 301, a density may be directly measured by the output signal of the sensor. That is, the reference pattern of at least one color need only be detected after the density detection pattern of the color.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-109932, filed on May 11, 2012, which is hereby incorporated by reference herein in its entirety.

What is claimed is:

1. An image forming apparatus comprising:

an image forming unit configured to form, for each of a plurality of colors, a density detection pattern for detecting a density and a reference pattern for specifying a position of the density detection pattern on an image carrier by a developer;

a light-receiving unit configured to receive reflection light of light emitted toward the image carrier, and output a signal corresponding to an amount of received light;

a sampling unit configured to sample the signal output from said light-receiving unit;

a storage unit configured to store sampling values sampled by the sampling unit;

a detection unit configured to detect the reference pattern formed on the image carrier by comparing the signal corresponding to the amount of received light with a threshold; and a determination unit configured to determine, for at least one of the plurality of colors, a sampling value corresponding to reflection light from the density detection pattern of the color among the sampling values stored in said storage unit, based on a detection time of the reference pattern of the color detected by said detection unit.

2. The apparatus according to claim 1, wherein said detection unit is further configured to detect the reference pattern by comparing the sampling values stored in said storage unit with the threshold.

3. The apparatus according to claim 1, wherein said detection unit is further configured to detect the reference pattern by comparing the signal output from said light-receiving unit with the threshold.

4. The apparatus according to claim 1, wherein at least one of the plurality of colors includes a color for which the density detection pattern reaches a reflection position of light emitted by said light-receiving unit before the reference pattern.

5. The apparatus according to claim 1, wherein said image forming unit is further configured to form one reference pattern and a plurality of density detection patterns on the image carrier for each color.

6. The apparatus according to claim 1, wherein said image forming unit is further configured to form, on the image carrier by the developer, a registration detection pattern for detecting misregistration together with the density detection pattern and the reference pattern.

7. The apparatus according to claim 1, wherein said image forming unit is further configured to form a plurality of registration detection patterns for detecting misregistration and a plurality of density detection patterns on the image carrier by the developer, forming positions of the plurality of registration detection patterns on the image carrier are decided according to a registration detection pattern constraint, forming positions of the plurality of density detection patterns on the image carrier are decided according to a density detection pattern constraint, and the reference pattern is formed at a position, on the image carrier, different from the decided forming positions of the plurality of registration detection patterns and the plurality of density detection patterns.

8. The apparatus according to claim 7, wherein the image carrier is an endless belt which is looped around a plurality of rollers, the registration detection pattern constraint includes a distance between the plurality of registration detection patterns and is m/2 times (m is an odd number) a rotation period of a roller for driving the endless belt among the plurality of rollers, and the density detection pattern constraint includes a distance between the plurality of density detection patterns and is n/2 times (n is an odd number) a rotation period of a tension roller for keeping tension on the endless belt among the plurality of rollers.

9. The apparatus according to claim 6, wherein the density detection pattern, the registration detection pattern, and the reference pattern are formed within one round of the image carrier.

10. An image forming apparatus comprising:

an image forming unit configured to form, for each of a plurality of colors, a density detection pattern for detecting a density and a reference pattern for specifying a position of the density detection pattern on an image carrier by a developer; and a light-receiving unit configured to receive reflection light of light emitted toward the image carrier, and output a signal corresponding to an amount of received light, wherein said image forming unit is further configured to form, for at least one of the plurality of colors, the density detection pattern of the color and the reference pattern of the color so that the density detection pattern reaches a reflection position of light emitted by said light-receiving unit before the reference pattern.

11. The apparatus according to claim 10, further comprising:

a detection unit configured to detect the reference pattern by comparing the signal corresponding to the amount of received light with a threshold, and a storage unit configured to store values of the signal corresponding to the amount of received light of said light-receiving unit in order to specify an amount of received light corresponding to reflection from the density detection pattern after said detection unit detects the reference pattern for a color for which the density detection pattern and the reference pattern are formed so that the density detection pattern reaches the reflection position of the light emitted by said light-receiving unit before the reference pattern.

12. The apparatus according to claim 10 wherein the density detection pattern and the reference pattern are formed within one round of the image carrier.

13. A method comprising the steps of:

forming, for each of a plurality of colors, a density detection pattern for detecting a density and a reference pattern for specifying a position of the density detection pattern on an image carrier by a developer;

receiving reflection light of light emitted toward the image carrier, and outputting a signal corresponding to an amount of received light;

sampling the output signal;

storing sampling values in a storage unit;

detecting the reference pattern formed on the image carrier by comparing the signal corresponding to the amount of received light with a threshold; and determining, for at least one of the plurality of colors, a sampling value corresponding to reflection light from the density detection pattern of the color among the sampling values stored in the storage unit, based on a detection time of the detected reference pattern of the color.

14. A method comprising the steps of:

forming, for each of a plurality of colors, a density detection pattern for detecting a density and a reference pattern for specifying a position of the density detection pattern on an image carrier by a developer;

receiving reflection light of light emitted toward the image carrier, and outputting a signal corresponding to an amount of received light; and forming, for at least one of the plurality of colors, the density detection pattern and the reference pattern of the color so that the density detection pattern reaches a reflection position of light emitted by a light-receiving unit before the reference pattern.

* * * * *